US008752710B2

(12) United States Patent
Frost

(10) Patent No.: US 8,752,710 B2
(45) Date of Patent: Jun. 17, 2014

(54) MOBILE SCREEN DEVICE WITH A FRAME PIVOTABLE ABOUT A VERTICAL TURNING AXIS

(76) Inventor: Magnus Frost, Eskilstuna (SE)

( * ) Notice: Subject to any disclaimer, the term of this patent is extended or adjusted under 35 U.S.C. 154(b) by 0 days.

(21) Appl. No.: 13/512,476

(22) PCT Filed: Nov. 30, 2010

(86) PCT No.: PCT/SE2010/051320

§ 371 (c)(1),
(2), (4) Date: May 29, 2012

(87) PCT Pub. No.: WO2011/065915

PCT Pub. Date: Jun. 3, 2011

(65) Prior Publication Data

US 2012/0234734 A1 Sep. 20, 2012

(30) Foreign Application Priority Data

Nov. 30, 2009 (SE) ..... 09015066

(51) Int. Cl.
*B07B 1/00* (2006.01)

(52) U.S. Cl.
CPC ..... *B07B 1/00* (2013.01)
USPC ..... 209/279; 209/235; 209/252; 172/605; 198/317; 198/793; 108/103; 248/349.1; 298/10

(58) Field of Classification Search
USPC ..... 209/233, 235, 252, 279, 288; 172/605; 198/313, 317, 318, 793; 108/313, 317, 108/318, 793, 103, 104; 248/649.1, 349.1; 211/163; 298/10; 312/8.3, 9.7
See application file for complete search history.

(56) References Cited

U.S. PATENT DOCUMENTS

| | | | | | |
|---|---|---|---|---|---|
| 4,624,357 | A * | 11/1986 | Oury et al. | 198/313 |
| 4,919,383 | A * | 4/1990 | Benjamin et al. | 248/349.1 |
| 5,819,950 | A * | 10/1998 | McCloskey | 209/288 |
| 5,890,764 | A * | 4/1999 | Lee | 248/349.1 |
| 5,979,666 | A | 11/1999 | Douglas | |
| 6,378,686 | B1 * | 4/2002 | Mayer et al. | 198/318 |
| 6,543,622 | B1 * | 4/2003 | Fridman | 209/420 |
| 2001/0032916 | A1 * | 10/2001 | Wess et al. | 248/349.1 |
| 2006/0237346 | A1 | 10/2006 | Fridman et al. | |
| 2012/0047667 | A1 * | 3/2012 | Arsenault et al. | 198/313 |

FOREIGN PATENT DOCUMENTS

| | | | |
|---|---|---|---|
| GB | 2459287 | A | 10/2009 |
| JP | 2003041618 | A * | 2/2003 |
| JP | 2003170118 | A | 6/2003 |
| WO | 9804783 | A1 | 2/1998 |

OTHER PUBLICATIONS

International Search Report, dated Mar. 1, 2011, from corresponding PCT application.

* cited by examiner

*Primary Examiner* — Gerald McClain
(74) *Attorney, Agent, or Firm* — Young & Thompson

(57) ABSTRACT

A mobile screening device for the screening of soil and other materials has a chassis (1), which is carried by at least one wheel (1.1) or a similar member, and a screen frame (2), which is carried by the chassis (1) and which includes at least one screen (5) that is supplied with material to be screened. The screen frame (2) is pivotable around a primarily vertical turning axis (7) in relation to the chassis (1).

19 Claims, 4 Drawing Sheets

MOBILE SCREEN DEVICE WITH A FRAME PIVOTABLE ABOUT A VERTICAL TURNING AXIS

The present invention relates to a mobile screening device for the screening of soil and other materials having a chassis, which is carried by at least one wheel or a similar member, and a screen frame, which is carried by said chassis and which comprises at least one screen that is supplied with material to be screened.

PRIOR ART

Screening devices for the separation of, e.g., stones and roots from a soil material are usually stationary, which generally means that unscreened material is transported to the screening assembly, is screened and divided into at least one useful fraction and one useless fraction, which should be deposited on, e.g., a dump. The useful fraction is in many cases used as refilling where the material once was excavated and accordingly has to be transported back to the place of origin. Therefore, there is a need of being able to screen, e.g., soil material on-site to avoid transports and unnecessary material handling.

A principally movable screening device is known from U.S. Pat. No. 5,285,905, but the device is not suited for, e.g., being moved along a pipe trench to refill material as excavation and piping advances. A screening device that is more suitable for a successive screening of material and repetitive movement is known from WO, A1, 9804783. This screening device has a chassis that is carried by caterpillar tracks and that carries an infeed bucket, a crushing device, a storage bin for soil improvement material as well as conveyors, an output conveyor of which for finished soil seems to be fixedly connected with the chassis. Similar screening devices are also known from JP, A, 2003041618 and JP, A, 2003170118 and have output conveyors that are fixedly connected with the chassis.

The caterpillar propulsion of the known screening devices is a disadvantage if the devices are to be transported longer distances, since they have to be transported on trailers. Another disadvantage of the known screening devices is that the infeed bucket and the output conveyor cannot be placed in a labour-saving way, e.g. when screening is to be made during successive movement of the screening device and, e.g., the excavator that excavates material and feeds the screening device. The chassis carried by caterpillar tracks has in such cases to be driven a distance, and then the entire chassis has to be rotated to come into position for a simultaneous excavation and replacement of screened material.

SUMMARY OF THE INVENTION

The object of the present invention is to provide a screening device that better meets the needs, e.g. in excavation and replacement of material. Thus, the invention embraces a mobile screening device for the screening of soil and other materials having a chassis, which is carried by at least one wheel or a similar member, and a screen frame, which is carried by said chassis and which comprises at least one screen that is supplied with material to be screened. Said screen frame is pivotable around a primarily vertical turning axis in relation to said chassis.

At least one feeding device may be arranged connected to said at least one screen and said screen frame may carry at least one output conveyor for finished screened material.

At least one locking device may be arranged between the chassis and the screen frame for the fixation of the position of the screen frame in relation to the chassis. The screen frame may be carried by a base, which is mounted to a turntable, which in turn is arranged on the chassis and has two mutually rotatable parts, wherein one part may be connected to the base and the other part may be connected to the chassis.

Said at least one locking device may comprise at least one tooth rim, which is connected with the base, and which further is connected to at least one lock member. At least one of said at least one lock member may be arranged to spring in between teeth on at least one of said at least one tooth rim by means of force from at least one spring, and to spring out when the screen frame is subjected to a horizontal force of a determined size that rotates the screen frame around the turning axis. The force from at least one of said at least one spring may be adjustable by means of at least one adjusting member.

By chassis, here all kinds of underframes with or without wheels or caterpillar tracks, which may be movable by their own engines or by towing by means of a traction vehicle or the like, are intended.

One or more feeding devices are arranged connected to occurring screens, preferably a feed hopper that in a free-standing way projects down into a spring-suspended feed bucket, which is provided with vibrators for the disintegration and feed of the material to the screen, which also is spring-suspended. The feed bucket has an outlet end, which suitably projects inwardly over the screen tray, inside which one or more mutually parallel grating-like screens are arranged. The screen tray also carries vibrators, by means of which the soil material is screened at the same time as separated coarser material is fed rearwardly and out through an opening in the rear end of the screen tray.

It is within the scope of the invention to implement the locking device in several different ways, e.g. in the form of friction blocks that abut against a brake disc that substitutes the chain wheel. It is also within the scope of the invention to rotate the screen frame mechanically, e.g. by means of an electric motor, which also may be remotely controlled from, e.g., the excavator operating at the screening device. This solution may advantageously be combined with different kinds of locking devices for the screen frame, which also may be remote-controlled.

An integrated drive generator is arranged hanging under the front part of the conveyor frame and comprises an internal combustion engine, which drives an electric generator. The belt conveyor and the vibrators are supplied with electric current from the integrated drive generator. To the integrated drive generator, a hydraulic pump may also be connected in the case hydraulic operation is an advantage.

By means of the screening device according to the invention, it is possible to carry out screening during successive movement of the screening device and, e.g., the excavator that excavates material and feeds the screening device. By means of the excavator, it is possible to tow the screening device to a desired location and there rotate the screen frame into a desired angle to the longitudinal direction of the chassis so that the excavator can feed in material into the feed hopper directly from the location where the material is excavated.

LIST OF FIGURES

Figure 5:
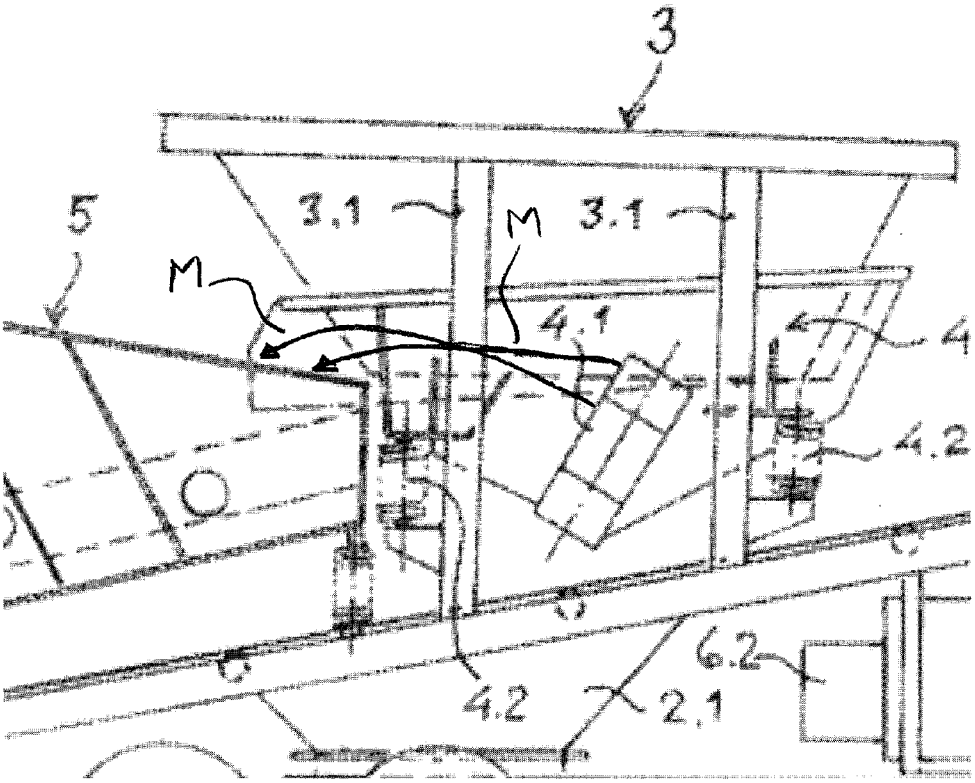

FIG. 5 schematically shows the feeding device throwing material to be screened rearwardly against the screen tray.

DESCRIPTION OF EMBODIMENTS

Figure 1:
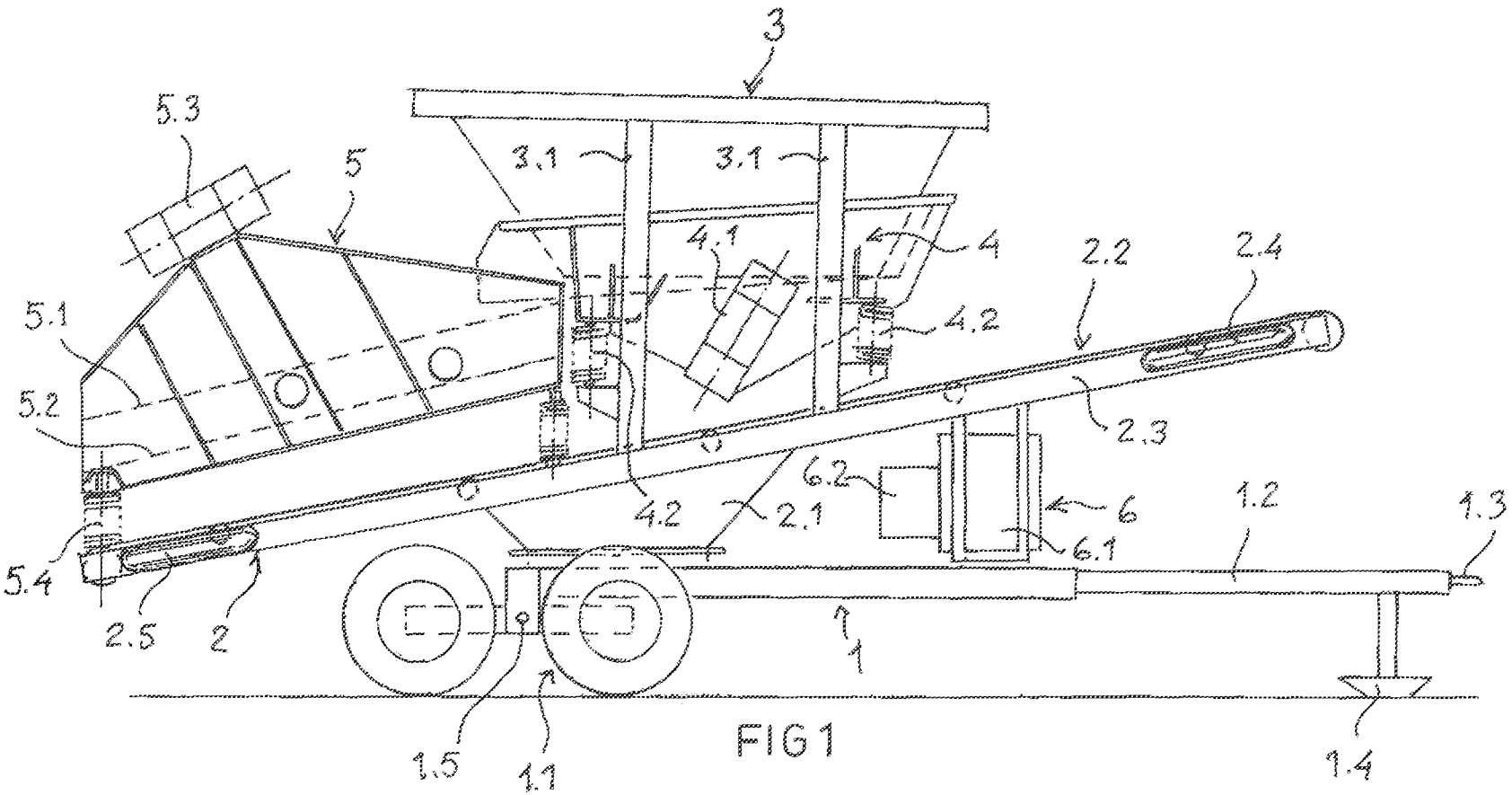
FIG. 1 shows, in a side view, a complete screening device according to the invention.

The screening device shown in FIG. 1 comprises a chassis 1, which on each side is carried by a wheel bogie 1.1 and which at its front part has a telescopic towbar 1.2, which in front is provided with a tow loop 1.3 and a support foot 1.4. The respective wheel bogie 1.1 is rotatable around a horizontal turning axis 1.5.

A screen frame 2 is carried by the chassis 1 and comprises a base 2.1 that is pivotable around a vertical pivot in relation to the chassis 1, and a belt conveyor 2.2 that is arranged in a conveyor frame 2.3 on the base 2.1. The conveyor frame 2.3 may slope 10-20°, preferably 11° to the horizontal plane. In FIG. 1, an inclination of approx. 15° is shown.

A feed hopper 3 for the soil material M is arranged on legs 3.1 that are attached to the conveyor frame 2.3 and project down freely into a feed bucket 4 provided with two electrically driven feed vibrators 4.1. The feed bucket is carried by four helical springs 4.2 connected to the conveyor frame 2.3. The feed vibrators 4.1 cause material M filled through the feed hopper 3 to be thrown upwardly and rearwardly against a screen tray 5 as shown schematically in FIG. 5. The feed bucket 4 has an outlet end, which projects inwardly over the screen tray 5 inside which two mutually parallel screen gratings 5.1, 5.2 are arranged. The screen tray 5 furthermore carries two electrically driven screen vibrators 5.3, by means of which the material M is screened at the same time as separated coarser material is fed rearwardly and out through an opening in the rear end of the screen tray 5. The screen tray 5 is carried by four helical springs 5.4 connected to the conveyor frame 2.3.

An integrated drive generator 6 is arranged hanging under the front part of the conveyor frame 2.3 and comprises an internal combustion engine 6.1, which drives an electric generator 6.2. The belt conveyor 2.2 and the vibrators 4.1, 5.3 are supplied with electric current from the integrated drive generator 6.

Figure 2:
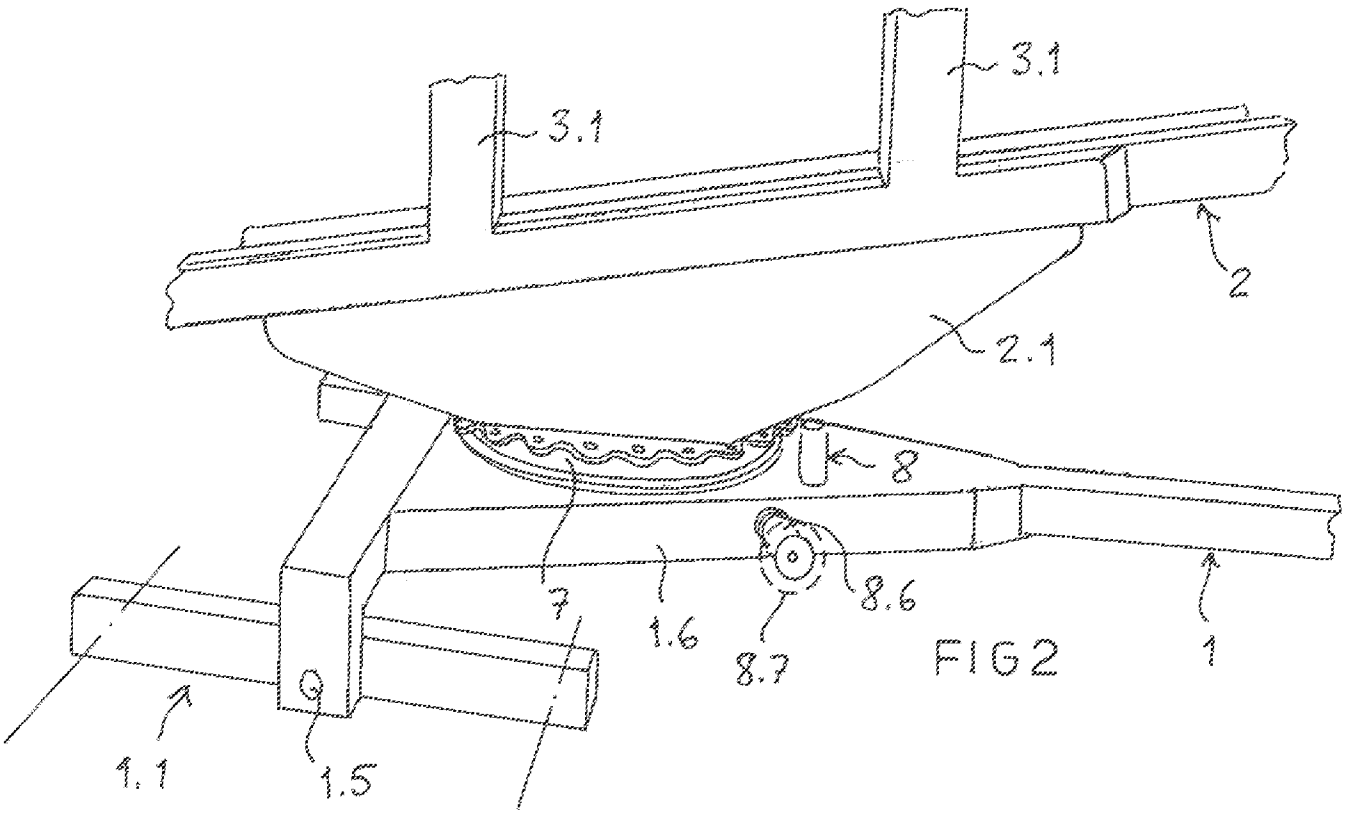
FIG. 2 shows, in a perspective view, a section of the screening device according to FIG. 1.

The base 2.1 of the screen frame 2 is, as shown in FIG. 2, connected with the chassis 1, which at its rear end has a triangular portion 1.6, via a conventional turntable 7. The turntable 7 principally consists of two rings having intermediate ball bearings, a lower ring of which is attached to the triangular portion 1.6 and an upper ring is attached to the base 2.1 of the screen frame 2. The turntable 7 is arranged at a distance in front of the turning axis 1.5 on the respective wheel bogie 1.1 so that the centre of gravity of the screen frame 2 always is lying between the wheel bogies 1.1 and the support foot 1.4, irrespective of which angular setting the screen frame 2 has in relation to the chassis 1.

Figure 3:
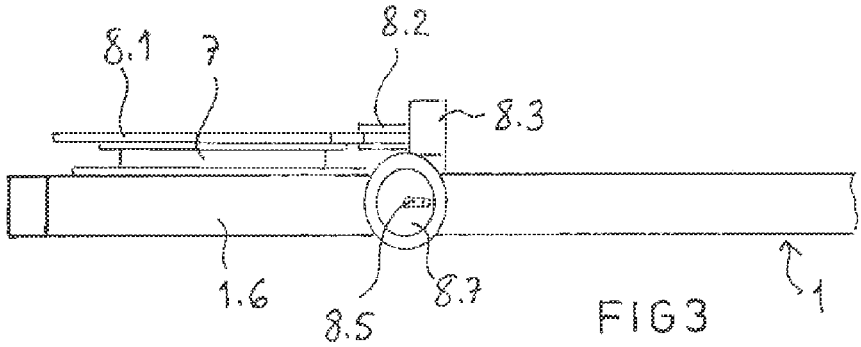
FIG. 3 shows, in a side view, a section of the chassis included in the screening device according to FIG. 1.
Figure 4:
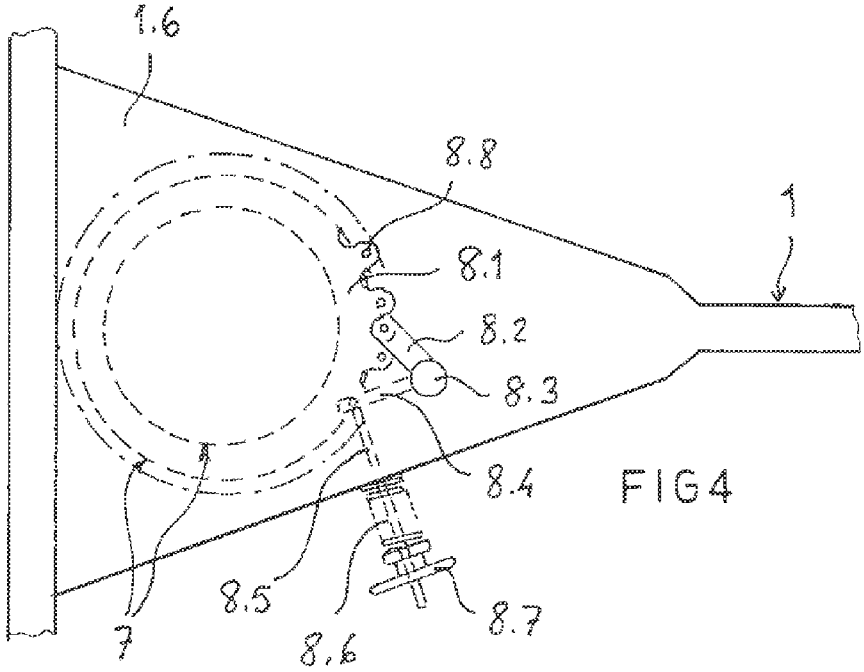
FIG. 4 shows, in a top view, the section of the chassis according to FIG. 3.

A locking device 8 shown in detail in FIGS. 3 and 4 is arranged to lock the screen frame 2 in a desired position in relation to the chassis 1 depending on the operating conditions when the screening device is in operation. The locking device 8 comprises a tooth rim 8.1 that is mounted between the turntable 7 and the base 2.1 in the screen frame 2. Thus, the tooth rim 8.1 follows the rotary motion of the base 2.1. Via a roller, e.g. a ball bearing, an upper lock arm 8.2 is in contact with the tooth rim 8.1 and is carried by a rotatable vertical pin 8.3 arranged on the triangular portion 1.6 of the chassis 1. A lower lock arm 8.4, which is arranged underneath the triangular portion 1.6, is also carried by the pin 8.3, and is connected to a towbar 8.5 that is threaded at its outer end and projects through a side wall of the triangular portion 1.6. The towbar 8.5 is held spring-loaded in a direction out from the triangular portion 1.6 by means of a helical spring 8.6. The force of the spring 8.6 can be set by means of a knob 8.7 so that the upper lock arm 8.2 can clamp the tooth rim 8.1 and thereby also the screen frame 2 in a desired position.

Upon a change of the position of the screen frame 2 in relation to the chassis 1, pressure is applied, e.g. by an excavator bucket or the like, against the side of the front part of the screen frame 2, whereby the upper lock arm 8.2 springs out from the tooth rim 8.1 into a new position. For this purpose, the screen frame 2 may be provided with rubber linings 2.4, 2.5 at each side at the front as well as the rear end. For a permanent setting of the position of the screen frame 2, e.g. during road transportation of the screening device, the tooth rim 8.1 can be locked, e.g. by a cotter (not shown) that is brought down into a hole in any one of the teeth of the tooth rim 8.1, down into a corresponding hole in the triangular portion 1.6.

A simple movement of the screening device is provided by pulling or pushing, e.g. by means of an excavator bucket, a member (not shown) projecting from the chassis 1 and arranged on the telescopic towbar 1.2. In longer distance transportation, the towbar 1.2 is coupled to, e.g., a wheel-loader via the tow loop 1.3.

The invention is not limited to the embodiments shown herein, but may be varied within the scope of the subsequent claims.

The invention claimed is:

1. A mobile screening device for the screening material, including soil, said device comprising:

a chassis (1), at least one wheel (1.1) carrying said chassis (1);

a screen frame (2) carried by said chassis (1), said screen frame comprising at least one screen (5) that is supplied with material to be screened into screened material and separated coarser material, said at least one screen (5) comprising an opening in a rear end for discharge of the separated coarser material, wherein said screen frame (2) is pivotable around a primarily vertical turning axis (7) in relation to said chassis (1);

at least one output conveyor (2.2) located below said at least one screen (5) and positioned to receive the screened material from said at least one screen (5) while the separated coarser material is fed rearwardly and out through the opening in the rear end of the at least one screen (5); and at least one feeding device (3, 4) comprising legs (3.1) attached to said at least one output conveyor (2.2), said at least one feeding device (3, 4) throwing the material to be screened rearwardly against said at least one screen (5).

2. The screening device according to claim 1, wherein, said at least one output conveyor (2.2) comprises a frame (2.3) and said legs (3.1) of the at least one feeding device (3, 4) are attached to said frame (2.3) so that said at least one feeding device (3, 4) is located vertically over length-wise region of said at least one output conveyor (2.2).

3. The screening device according to claim 2, wherein at least one locking device (8) is arranged between the chassis (1) and the screen frame (2) for the fixation of the position of the screen frame (2) in relation to the chassis (1).

4. The screening device according to claim 1, further comprising at least one locking device (8) arranged between the chassis (1) and the screen frame (2) for the fixation of the position of the screen frame (2) in relation to the chassis (1).

5. The screening device according to claim 4, wherein the screen frame (2) is carried by a base (2.1), which base is mounted to a turntable (7), which turntable (7) in turn is arranged on the chassis (1) and has two mutually rotatable parts, one part being connected to the base (2.1) and the other part being connected to the chassis (1, 1.6).

6. The screening device according to claim 5, wherein said at least one locking device (8) comprises at least one tooth rim (8.1) connected with the base (2.1), and further connected to at least one lock member (8.2).

7. The screening device according to claim 6, wherein at least one of said at least one lock member (8.2) is arranged to spring in between teeth on at least one of said at least one tooth rim (8.1) by means of force from at least one spring (8.6), and to spring out when the screen frame (2) is subjected to a horizontal force of a determined size that rotates the screen frame (2) around the turning axis (7).

8. The screening device according to claim 7, wherein the force from at least one of said at least one spring (8.6) is adjustable by means of at least one adjusting member (8.7).

9. The screening device according to claim 1, wherein the screen frame (2) is carried by a base (2.1), which base is mounted to a turntable (7), which turntable (7) in turn is arranged on the chassis (1) and has two mutually rotatable parts, one part being connected to the base (2.1) and the other part being connected to the chassis (1, 1.6).

10. The screening device according to claim 1, wherein, said chassis (1) comprises, at a front end thereof, a the telescopic towbar (1.2), said chassis being towable by an escavator via said towbar (1.2).

11. The screening device according to claim 10, wherein, said towbar (1.2) comprises a tow loop (1.3) and a support foot (1.4) located at a distal end of said towbar (1.2).

12. The screening device according to claim 10, wherein, said at least one wheel (1.1) carrying said chassis (1) comprises a wheel bogie (1.1) located at a rear end of said chassis (1), said at least one output conveyor (2.2) is pivotable around the vertical turning axis (7) in relation to said chassis (1).

13. The screening device according to claim 12, wherein, said at least one output conveyor (2.2) is inclined within a slope limited to from 10 to 20 degrees.

14. The screening device according to claim 12, further comprising:

a turntable (7) that provides the vertical turning axis, the turntable being mounted at a rear end of the chassis (1), the turntable (7) comprising upper and lower rings having intermediate ball bearings therebetween, the lower ring being attached to the chassis (1) and the upper ring being attached to the at least one output conveyor (2.2), and said turntable (7) is located on said chassis (1) forward of said wheel bogie (1.1).

15. The screening device according to claim 1, wherein, said at least one feeding device (3, 4) comprises i) a feed hopper (3) and ii) a feed bucket (4), said feed hopper (3) being arranged on the legs (3.1) and projecting down freely into said feed bucket (4), said feed bucket (4) being provided with two electrically driven feed vibrators (4.1) and carried by plural helical springs (4.2) connected to said at least one output conveyor (2.2), and said feed vibrators (4.1) cause the material filled through the feed hopper (3) to be thrown upwardly and rearwardly against said at least one screen (5).

16. The screening device according to claim 15, wherein, said at least one screen (5) comprises i) two mutually parallel screen gratings (5.1, 5.2) and ii) screen vibrators (5.3) the screen vibrators acting on the screen gratings to so that the material is screened at the same time as separated coarser material is fed rearwardly and out through the opening in the rear end of the at least one screen (5).

17. The screening device according to claim 1, further comprising:

a drive generator (6) arranged hanging under a front part of the at least one output conveyor (2.2), the drive generator (6) driving an electric generator (6.2), the electric generator (6.2) driving the at least one output conveyor (2.2).

18. The screening device according to claim 1, further comprising:

a turntable (7) that provides the vertical turning axis, the turntable being mounted at a rear end of the chassis (1), the turntable (7) comprising upper and lower rings having intermediate ball bearings therebetween, the lower ring being attached to the chassis (1) and the upper ring being attached to the at least one output conveyor (2.2).

19. The screening device according to claim 1, wherein, said at least one screen (5) is carried by plural helical springs (5.4) connected to the at least one output conveyor (2.2).

* * * * *